US010154706B2

(12) United States Patent
Poulakis

(10) Patent No.: US 10,154,706 B2
(45) Date of Patent: Dec. 18, 2018

(54) FLAT TOUCH-AND-CLOSE FASTENER ELEMENT AND CLEANING SYSTEM COMPRISING SUCH A FLAT TOUCH-AND-CLOSE FASTENER ELEMENT

(71) Applicant: GOTTLIEB BINDER GMBH & CO. KG, Holzgerlingen (DE)

(72) Inventor: Konstantinos Poulakis, Hildrizhausen (DE)

(73) Assignee: GOTTLIEB BINDER GMBH & CO. KG, Holzgerlingen (DE)

( * ) Notice: Subject to any disclaimer, the term of this patent is extended or adjusted under 35 U.S.C. 154(b) by 381 days.

(21) Appl. No.: 14/895,566

(22) PCT Filed: May 28, 2014

(86) PCT No.: PCT/EP2014/001431

§ 371 (c)(1),
(2) Date: Dec. 3, 2015

(87) PCT Pub. No.: WO2014/198381

PCT Pub. Date: Dec. 18, 2014

(65) Prior Publication Data

US 2016/0106185 A1 Apr. 21, 2016

(30) Foreign Application Priority Data

Jun. 10, 2013 (DE) ..... 10 2013 010 085

(51) Int. Cl.
*A44B 18/00* (2006.01)
*A47L 13/24* (2006.01)

(52) U.S. Cl.
CPC ..... *A44B 18/0034* (2013.01); *A44B 18/0023* (2013.01); *A44B 18/0069* (2013.01); *A44B 18/0092* (2013.01); *A47L 13/24* (2013.01)

(58) Field of Classification Search
CPC ..... A44B 18/0034; A44B 18/0023; A44B 18/0069; A44B 18/0092; A47L 13/24; A47L 13/20
See application file for complete search history.

(56) References Cited

U.S. PATENT DOCUMENTS 5,176,944 A * 1/1993 Striegl ..... A44B 18/0069 24/445
5,373,712 A * 12/1994 Yamamoto ..... A44B 18/0034 24/450

(Continued)

FOREIGN PATENT DOCUMENTS

DE 87 09 084 8/1987
DE 100 12 692 9/2001

(Continued)

OTHER PUBLICATIONS

International Search Report (ISR) dated Sep. 11, 2014 in International (PCT) Application No. PCT/EP2014/001431.

*Primary Examiner* — Weilun Lo
(74) *Attorney, Agent, or Firm* — Wenderoth, Lind & Ponack, L.L.P.

(57) ABSTRACT

A flat touch-and-close fastener element, which is detachably connected to a second touch-and-close fastener element, thereby forms a touch-and-close closure. The fastener element has a system of threads (10) of warp and weft threads, as well as pile threads. The individual threads have different chemical and/or physical properties and, for this purpose, are formed of different materials.

18 Claims, 6 Drawing Sheets

(56) References Cited

U.S. PATENT DOCUMENTS

| | | | | |
|---|---|---|---|---|
| 5,745,961 | A | 5/1998 | Okawa et al. | |
| 6,216,496 | B1 * | 4/2001 | Gehring | A44B 18/0034 66/191 |
| 2004/0099019 | A1 * | 5/2004 | Sasser | A44B 18/0034 66/195 |
| 2005/0132543 | A1 * | 6/2005 | Lindsay | A44B 18/0015 24/442 |
| 2009/0036013 | A1 | 2/2009 | Poulakis | |
| 2010/0269282 | A1 * | 10/2010 | Kaminer | A47L 13/20 15/209.1 |
| 2011/0023251 | A1 * | 2/2011 | Bober | A47L 13/256 15/228 |
| 2012/0010588 | A1 * | 1/2012 | Morishita | A44B 18/0034 604/391 |
| 2012/0027987 | A1 * | 2/2012 | Poulakis | H01R 13/6485 428/100 |
| 2012/0058295 | A1 * | 3/2012 | Poulakis | A44B 18/0069 428/91 |

FOREIGN PATENT DOCUMENTS

| | | |
|---|---|---|
| DE | 102 40 986 | 2/2004 |
| DE | 601 06 655 | 11/2005 |
| DE | 20 2006 002 409 | 5/2006 |
| EP | 0 780 066 | 6/1997 |
| EP | 1 949 810 | 7/2008 |

* cited by examiner

FLAT TOUCH-AND-CLOSE FASTENER ELEMENT AND CLEANING SYSTEM COMPRISING SUCH A FLAT TOUCH-AND-CLOSE FASTENER ELEMENT

FIELD OF THE INVENTION

The invention relates to a flat touch-and-close fastener element detachably connected to another touch-and-close fastener element to form a releasable touch-and-close fastener. The fastener element is formed of a thread system having warp and weft threads as well as pile threads. This type of touch-and-close fastener element for a touch-and-close fastener element is known from patent DE 102 40 986 B3.

BACKGROUND OF THE INVENTION

Woven touch-and-close fastener elements whose warp, weft and pile threads are all made of textile fibers, but can also be formed of plastic or metal fibers, are freely available on the market in numerous designs. The pile threads in the ground fabric formed of warp and weft threads have loop-shaped hook elements. The threads of the thread system can be formed of multifilament threads or multifilament yarns. In particular, if the pile threads are formed from monofilament threads or monofilament yarns, the relevant closed pile thread loops can be cut or thermally separated from each other to then obtain resilient locking hooks that can be releasably engaged with a correspondingly designed fleece loop material of the other touch-and-close fastener element.

If the loop ends are thermally treated, for example melted, in the cutting process, mushroom-shaped fastening heads arise during subsequent hardening as fastening elements from the inherent tension behavior of the melted plastic material. Furthermore, such hook or mushroom-shaped fastening elements can releasably engage with each other or with felt touch-and-close fastener elements, and form the touch-and-close fastener as a whole.

With such known touch-and-close fastener systems, very favorable pealing resistance values are achievable, i.e., relatively high force is required to cause the flat, corresponding touch-and-close fastener elements that form the touch-and-close fastener as a whole to release the connection, which is always desirable.

With the known solutions, plastic materials, in particular in the form of nylon or polypropylene material, are also used as the thread and yarn systems, in addition to textile fiber materials. Furthermore, the use of metal thread systems has also been proposed for the known solution. However, only one production material is consistently used for the entire thread system for each known fastening material.

When using the known thread or yarn material consist of only one production material, a highly favorable basic stability for the entire fabric is achieved. In particular, the pile threads cannot be easily removed from the ground fabric by a corresponding hook fastening material when the touch-and-close fastener is pulled apart. Viewed over the long term, that difficult removal would undesirably impair the functioning of the touch-and-close fastener. If only such stable thread systems are used, they lose their ability to fasten or close from frequent washing, in particular when high temperatures are used for the washing medium for reasons of disinfection or sterilization. The employed cleanser frequently also proves to be very aggressive toward the thread system of the employed textile and plastic materials.

The invention furthermore relates to a cleaning system using such a flat touch-and-close fastener element. The cleaning systems are also colloquially termed mops. If such mop cleaning systems are for example used in hospitals, increased disinfection and sterility requirements accordingly exist. The flat wiping material used for the cleaning system is provided on the back side with the flat touch-and-close fastener element to be connected to a hand-actuatable holder with a corresponding touch-and-close fastener element. The holder is preferably movable along a floor surface to be cleaned by a handle part. The flat wiping material is supposed to be able to withstand at least 500 washing cycles in daily washings over the anticipated life. Furthermore, the touch-and-close fastener element used in such cleaning systems, which is designed to be correspondingly robust for use, is supposed to be able to effectively withstand normal abrasion or fabric delamination.

The known touch-and-close fastener systems with the assignable cleaning systems only insufficiently satisfy these requirements, which is regularly reflected by a short life of the products.

SUMMARY OF THE INVENTION

An object of the invention is to provide improved flat touch-and-close fastener elements, in addition to assignable cleaning systems using such touch-and-close fastener elements, so that they prove robust and enduring when used and, in particular, can survive numerous cleaning processes without delamination of the thread fabric system occurring. A flat touch-and-close fastener element according to the invention achieves such objective, as well as a cleaning system using such touch-and-close fastener element according to the invention.

To achieve this objective with a flat touch-and-close fastener element, according to the invention, the individual threads of the thread system have different chemical and physical properties, and for this purpose are formed of different materials, in particular in the form of plastic materials. Particularly preferably, at least part of the threads are formed of polyamide material, and another part of the threads are formed of polyester material.

In terms of its surface structure, the polyamide thread is considered relatively rough on the microscopic level, and therefore, offers a favorable receptive base for finishes that are regularly used to help improve the cohesion within the ground fabric system of warp and weft fibers. However, the plastic material, polyamide, is considered highly hydrophilic. In particular, polyamide likes to swell upon the infiltration of water and becomes softer in terms of the strength values, with the consequence that the stability of the thread system decreases upon the infiltration of water. A thread system constructed exclusively of polyamide materials for the touch-and-close fastener element then is less suitable for frequent washing cycles viewed over the long term. If disinfectants and sterilizing agents, which normally are highly oxidizing (such as perchlorate and peracetic acids), are used together with the wash water, the resistance of the polyamide proves to be low since the molecular structure of polyamide normally has amino end groups that produce end products with the cited disinfectants and sterilizing agents in a chemically reactive manner and that break down the polyamide in the thread system.

In contrast, polyester as the plastic thread material with a normally smooth surface structure proves to be a hydrophobic added fabric material that, in addition, does not have any functional amino groups. Frequent washing using disinfectants and sterilizing agents therefore cannot harm the polyester thread material. In particular, chemical decomposition compounds do not arise because the polyester does not have any functional groups, in particular amino end groups, in the molecular structure. Given the smooth surface structure of the polyester thread material, physical adhesion of the finish material does not occur. It only mechanically encloses the respective polyester fiber and can easily release from the fiber under mechanical stress.

Surprisingly to the average person skilled in the art of touch-and-close fasteners, the functional properties of the touch-and-close fastener element, or respectively the touch-and-close fastener material, can be freely adjusted within wide ranges by selectively choosing thread or yarn material for partial thread systems of an overall thread system. Furthermore, by additionally or alternatively introducing electrically conductive fiber material, such as in the form of carbon fibers, the static discharge of the touch-and-close fastener element can be improved. If metal threads with a specifiable electrical resistance are introduced into the overall thread composite system, the touch-and-close fastener material can be heated by connecting the metal threads to a corresponding electricity source. Such an addition of heat can serve to kill microorganisms in the fastener material of the touch-and-close fastener element so that in this context as well, maximum disinfection and sterilization requirements can be easily satisfied.

Particularly advantageous is using the flat touch-and-close fastener element according to the invention in a mop, to form the weft threads of the thread system that extend over a long thread path as the long weft threads from polyamide, and the contrastingly shorter partial weft threads from polyester. Furthermore, forming 50% of the pile threads used within the thread system from polyester, and the other 50% part from polyamide threads or yarns is proven to be advantageous. Of course, other percentage compositions can also be used, such as 40% polyamide to 60% polyester within the thread composite system.

For the ground fabric of the warp and weft threads, the conventional fabric interconnections can be used, as well as knitted material. Particularly preferably the thread system as a Raschel knit. Raschel knitting on a Raschel machine is a type of known warp knitting. Further information on Raschel machines can for example be found in the "Große Textil-Lexikon", published by Deutsche Verlagsanstalt Stuttgart, as well as the introductory manual "Textile Fertigungsverfahren", published by Hanser-Verlag Munich.

For an improved attachment of the individual threads or individual yarns, the thread system is provided with a finish on its side facing away from the pile threads, i.e. on its rear side. As the finish, a solvent-free, moisture-cured hot melt adhesive based on reactive polyurethane prepolymers can for example be used that contains at least one polyester polyol at a concentration between 10 and 90%, possibly polyether polyol at a concentration of 0 to 50%, as well as at least one polyisocyanate at a concentration by weight between 5 and 35%. Using such a polyurethane material causes the individual weave components to strongly adhere to each other in the thread system so that a pulling out of individual threads, especially the pile threads in the basic texture, is reliably suppressed.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure and that are basic and not to scale.

DETAILED DESCRIPTION OF THE INVENTION

As mentioned above, FIG. 1 shows a rectangular section in a perspective view of a part of a flat touch-and-close fastener element according to the invention, without an applied finish. The flat touch-and-close fastener element can be connected to another touch-and-close fastener element in a releasable manner, in particular, while forming a touch-and-close fastener, as further explained below with reference to a cleaning system. The touch-and-close fastener element has a thread system 10, formed of warp threads 12 that, in the perspective facing FIG. 1, extend in a vertical direction, and formed of weft threads 14 that contrastingly extend in a horizontal direction and formed of pile threads 16 in the basic weave system of the warp threads and weft threads 12, 14.

Figure 1:
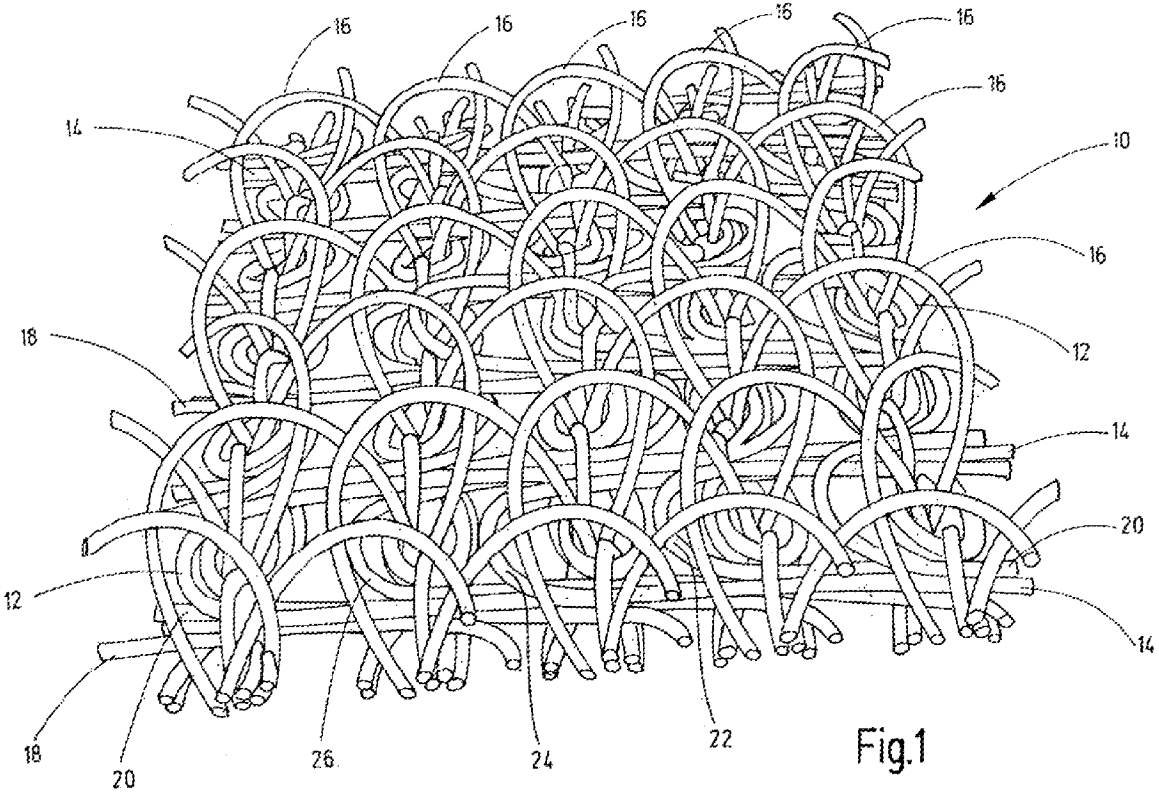
FIG. 1 is a rectangular, perspective section of a part of a flat touch-and-close fastener element according to an exemplary embodiment of the invention without finish.
Figure 2:
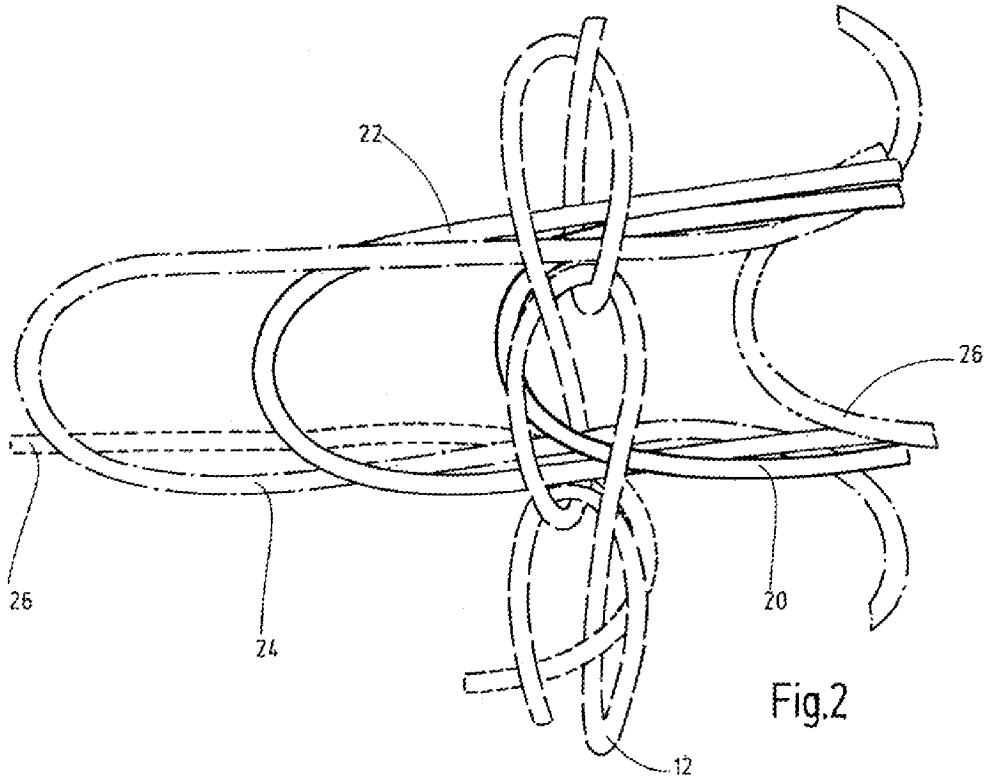
FIG. 2 is an enlarged perspective view of a section from the thread system of FIG. 1, only with one warp thread and four partial weft threads that are positioned by the warp threads in their weft direction, wherein the associated pattern repeats after four partial weft threads.

Long weft threads 18 extend within the thread system 10 over a longer thread path and preferably extend over the entire length or width of the entire thread system. In addition to these long weft threads 18 that, when viewed in the perspective facing toward FIG. 1, are arranged in a vertical direction in equidistant distances to each other, four partial weft threads 20, 22, 24 and 26 extend parallel to the long weft threads 18. The pattern viewed in the weft direction, repeats with the incorporation of the first partial weft thread 20 and each additional partial weft thread 22, 24, 26. For a better view, the relevant structure is depicted in FIG. 2. The individual partial weft threads are depicted with different outlines next to the warp thread 12. The warp thread 12, which extends vertically in the view of FIG. 2, forms a multi-loop system and penetrates the four partial weft threads 20, 22, 24, 26 between the neighboring loops of the warp thread 12, while incorporating the relevant warp thread 12. Starting at the fourth partial weft thread 26, the pattern repeat repeats beginning with the first partial weft thread 20 and, as shown on the right in the perspective facing FIG. 2, terminates with the fourth partial weft thread 26. Preferably according to the representation in FIG. 1, an independent warp thread system 12 exists for each partial weft thread.

Figure 3:
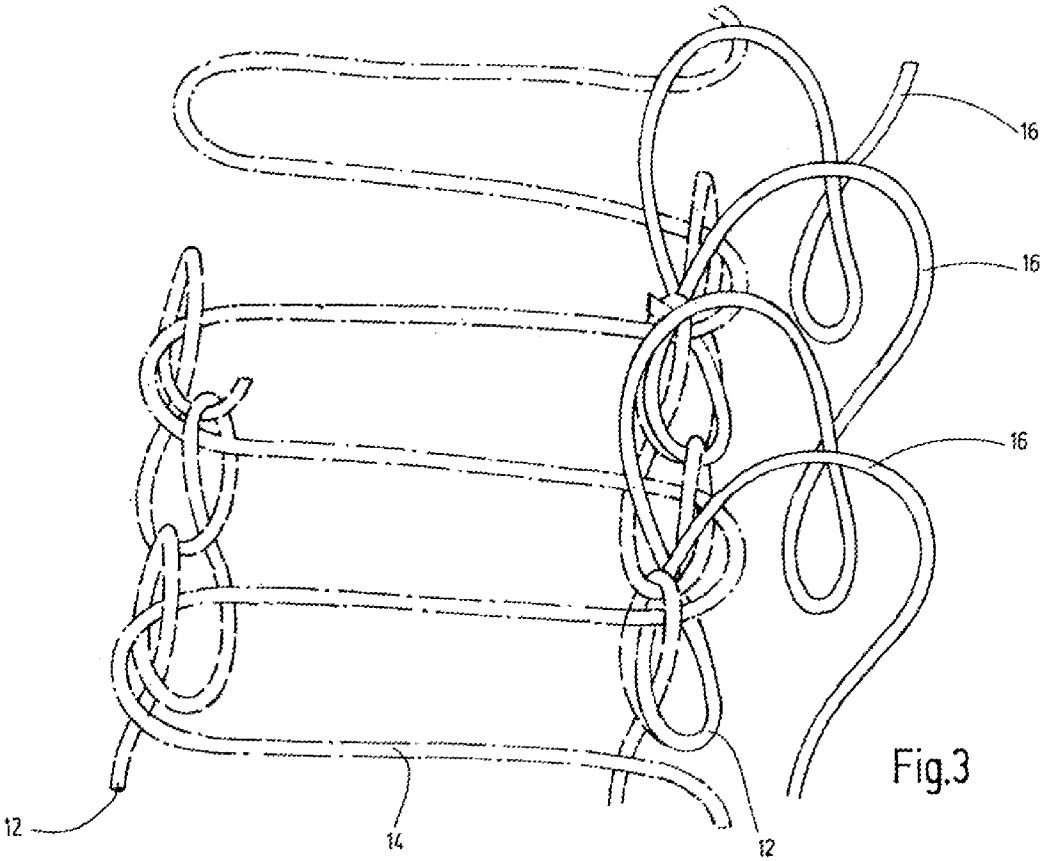
FIG. 3 is a perspective view of a partial thread system of FIG. 1, with two warp threads that are only partially shown, one partial weft thread, as well as an incorporated pile thread in the warp thread on the right in FIG. 3.

In particular, according to the representation in FIG. 2, the double incorporation is shown therein between two neighboring warp threads 12 for one of the partial weft threads 20. Furthermore, FIG. 3 shows the incorporation of a loop-forming pile thread 16 in the right warp thread system 12. If the weave structure according to FIGS. 2 and 3 is combined in an obvious manner, the overall pattern results according to the representation in FIG. 1.

To achieve different functions for the thread system, the warp threads 12 all are formed of polyester material, and one part of the pile threads 16 is formed of polyamide. The other, preferably half, part of the pile threads 16 are formed of polyester. Furthermore, the long floating long weft threads 18 that extend over the entire weave are made of polyamide plastic material, whereas the partial weft threads 20, 22, 24, 26 preferably are formed of polyester or have such polyester materials. Other material combinations are used depending on the context in which the addressed function of the individual components is to be adjusted.

Figure 4:
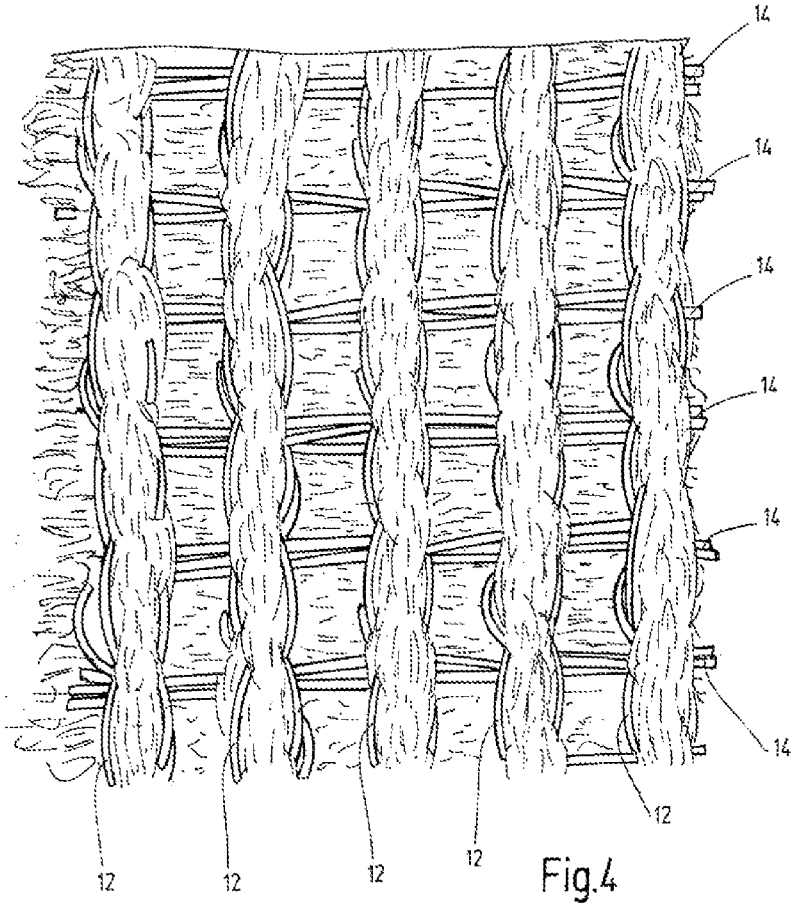
FIG. 4 is a plan view of the partial section of a thread system according to FIG. 1, wherein at least the pile threads are formed of multifilament threads or yarns.

In a particularly preferred form of the touch-and-close fastener element according to the invention, as FIG. 4 furthermore shows, at least the pile threads 16 are multifilament threads, i.e., an individual thread or individual yarn is divided into a plurality of individual filaments that all form a loop shape and are particularly suitable for interacting with a corresponding fastening material, such as in the form of fastening hooks for a releasable touch-and-close fastener. Accordingly in the representation in FIG. 4, the warp thread systems 12, the weft thread systems 14 with the long weft threads 18, as well as the partial weft threads 20 or 22, 24 and 26, are designed as monofilament threads. One embodiment (not shown) can incorporate the relevant warp and weft threads 12, 14 as multifilament threads in the weave for additionally improved adhesion.

The touch-and-close fastener elements shown as examples in FIGS. 1 and 4 with their woven or knit structure can be produced on Raschel machines (not shown) which are generically considered to be warp knitting looms. Such Raschel machines normally have two rows of latch needles and six rows of guide needles, where both the hook needles as well as the guide needles are integrally held, in particular combined in the form of needle bars or guide bars. A nonmoving knock over comb on the upper end possesses comb-shaped milled slots for the needle passage and assumes the functions of ADVANCE, APPLY and KNOCK OVER by a movement relative to the needle bar. The threads are then combined into the warps, in particular as warp beams or section warp beams on Raschel machines. The threads are then fed to the needles through the guide bars. The warp beams are driven separately. The Raschel fabric produced in this manner is then pulled off in the bottom part of the machine frame by a pull-off device and provided for subsequent use (see "Groβes Textillexikon", Deutsche Verlagsanstalt Stuttgart).

In order to ensure the weave according to the representations in FIGS. 1 and 4 between the individual threads of the overall thread system 10, they are provided with a finish on the side opposite the pile threads 16, preferably in the form of a polyurethane material applied to the whole surface. In addition to the presented threads, other threads can also be used with in particular a linear configuration that are flame retarding, and/or electrically conductive, and/or thermally conductive, and/or strength-value increasing. In addition to metal threads, nylon or carbon threads can also be used, or thread systems coated with flame retardant. A part of the described partial weft threads can accordingly be replaced by such a different thread. The use of bicomponent fibers in the overall thread structure 10 is also conceivable in principle.

Figure 5:
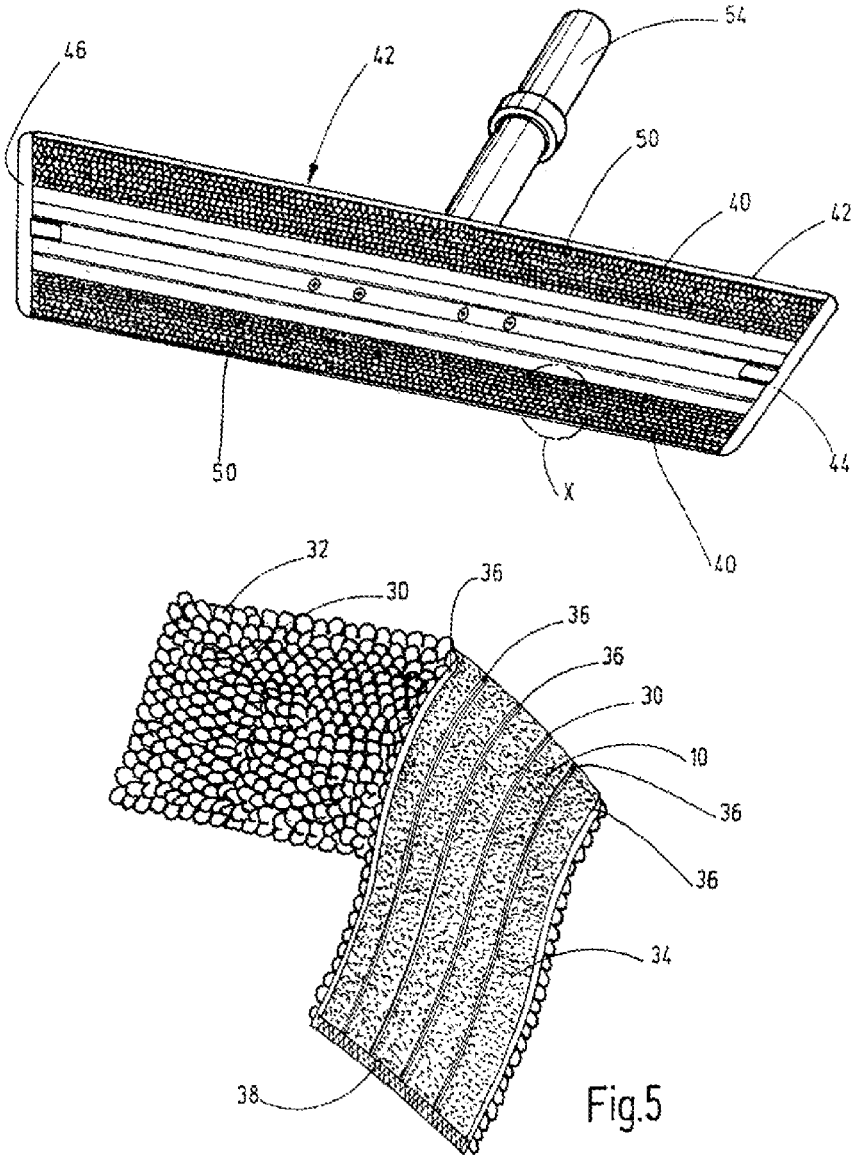
FIG. 5 is an exploded, perspective view of a wiper, at the very bottom, that can be connected via a touch-and-close fastener to the holder portrayed at the very top.
Figure 6:
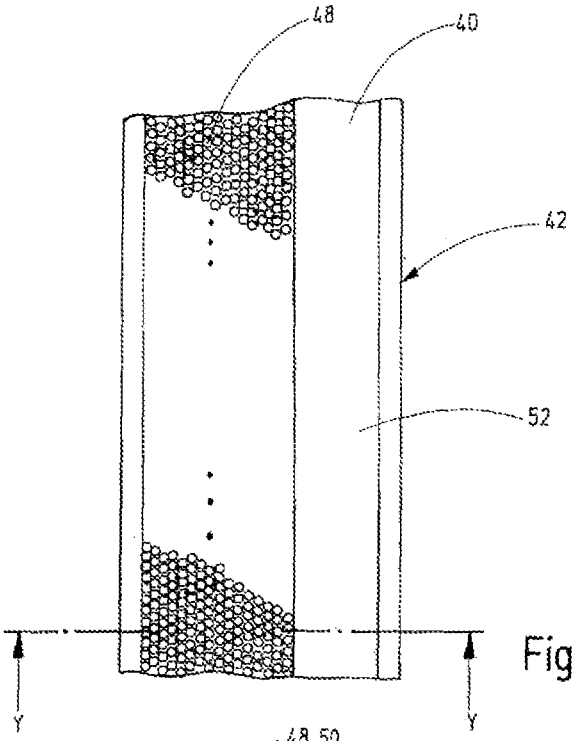
FIG. 6 is an enlarged partial bottom view of a section of the holder according to FIG. 5 enclosed in a circle X of FIG. 5.
Figure 7:
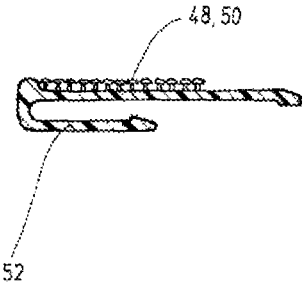
FIG. 7 is an end view in section of the section of the holder taken along line Y-Y in FIG. 6.

FIG. 5 shows the use of the touch-and-close fastener element according to the invention in a cleaning system, in particular in the form of a mop, in which a flat wiping material 30 including a plurality of wiping loops 32, for example, of a cotton material, is provided on the rear side 34 with the thread system 10. In particular, the thread system 10 is sewn to the rear side along longitudinal and transverse seams 36 and 38. In order to represent both the front side and rear side of the wiping material in the form of the wiper, the front side of the wiping material is represented on the left half of the image in FIG. 5, and the rear side is represented folded over on the right side. The thread system portrayed as an example in FIG. 4 is then on the right side of the image in FIG. 5 facing the viewer and is able to engage with two hook and loop strips 40 that extend along the bottom side of a holder 42 from the one side 44 of the holder to its other side 46, while correspondingly forming a releasable touch-and-close fastener. The holder 42 is preferably produced from an aluminum or plastic profile material. The individual hook and loop strips 40 with the projecting hook material 48 as an additional fastener element 50 can be pulled off of the holder 42 in the manner of a hollow profile 52 (see FIG. 7) so that it can be easily exchanged from the holder in case of failure, and/or can be easily washed or otherwise cleaned using the removable hollow profile 52. In particular, the holder 42 can be reused immediately when the respective hollow-profile 52 is exchanged. On its top side, the holder 42 is provided with a handle part 54. In the depicted embodiment, such a holder 42 with a handle part 54 can for example be used to clean window or working surfaces. If the handle part 54 on the holder 42 is correspondingly extended (not shown), such cleaning system can also easily be used to clean floors of any kind in addition to their floor coverings. If the wiping material 30 is used or dirty, the relevant wiping material or wiping means 30 can be exchanged for a new part using the portrayed Klett® connection system. The used or dirty wiping material 30 can then be washed and preferably reused in a disinfected form for additional cleaning processes as a part of the described cleaning system with a holder 42.

While one embodiment has been chosen to illustrate the invention, it will be understood by those skilled in the art that various changes and modifications can be made therein without departing from the scope of the invention as defined in the claims.

The invention claimed is:

1. A flat touch-and-close fastener element connectable to another touch-and-close fastener element to form a releasable touch-and-close fastener, the flat touch-and-close fastener element comprising:

a thread system having warp threads, weft threads, and pile threads, individual ones of said warp threads, weft threads or pile threads having different chemical or physical properties provided by the individual ones of the warp threads, weft threads or pile threads being formed of different materials, said weft threads extending over a long thread path as longer weft threads within said thread system being formed of polyamide, said weft threads extending over a shorter thread path as shorter partial weft threads being formed of polyester.

2. A touch-and-close fastener element according to claim 1 wherein said warp threads are formed of polyester; and
at least parts of said pile threads are formed of polyamide.

3. A touch-and-close fastener element according to claim 1 wherein
parts of said pile threads are formed of polyester; and
other parts of said pile threads are formed of polyamide.

4. A touch-and-close fastener element according to claim 1 wherein
a partial weft fiber is incorporated into a weave pattern of said thread system for each warp thread course with two of said pile threads being followed by four warp thread courses, said weave pattern restarting beginning with one of said shorter partial weft threads.

5. A touch-and-close fastener element according to claim 1 wherein
each of said threads of said thread system are made of multifilaments.

6. A touch-and-close fastener element according to claim 1 wherein
said thread system is a Raschel knit.

7. A touch-and-close fastener element according to claim 1 wherein
said thread system has a finish thereon.

8. A touch-and-close fastener element according to claim 7 wherein
said finish comprises a polyurethane material on a side of said thread system facing away from said pile threads.

9. A touch-and-close fastener element according to claim 1 wherein
said thread system comprises at least one of flame retardant linear elements, electrically conductive linear elements, thermally conductive linear elements or strength value increasing linear elements in addition to said warp threads, said weft threads and said pile threads.

10. A cleaning system, comprising:
a flat wiping material having a back side; and
a manually actuatable holder having a handle and a hook material on a surface of said holder; and
a flat touch-and-close fastener element on said back side of said flat wiping material and releasably connected to said hook material, said flat touch-and-close fastener element including a thread system having warp threads, weft threads, and pile threads, individual ones of said warp threads, weft threads or pile threads having different chemical or physical properties provided by the individual ones of the warp threads, weft threads or pile threads being formed of different materials, said weft threads extending over a long thread path as longer weft threads within said thread system being formed of polyamide, said weft threads extending over a shorter thread path as shorter partial weft threads being formed of polyester.

11. A cleaning system according to claim 10 wherein
said warp threads are formed of polyester; and
at least parts of said pile threads are formed of polyamide.

12. A cleaning system according to claim 10 wherein
parts of said pile threads are formed of polyester; and
other parts of said pile threads are formed of polyamide.

13. A cleaning system according to claim 10 wherein
a partial weft fiber is incorporated into a weave pattern of said thread system for each warp thread course with two of said pile threads being followed by four warp thread courses, said weave pattern restarting beginning with one of said shorter partial weft threads.

14. A cleaning system according to claim 10 wherein
each of said threads of said thread system are made of multifilaments.

15. A cleaning system according to claim 10 wherein
said thread system is a Raschel knit.

16. A cleaning system according to claim 10 wherein
said thread system has a finish thereon.

17. A cleaning system according to claim 16 wherein
said finish comprises a polyurethane material on a side of said thread system facing away from said pile threads.

18. A cleaning system according to claim 10 wherein
said thread system comprises at least one of flame retardant linear elements, electrically conductive linear elements, thermally conductive linear elements or strength value increasing linear elements in addition to said warp threads, said weft threads and said pile threads.

* * * * *